US010981173B1

(12) United States Patent
Kieffer

(10) Patent No.: US 10,981,173 B1
(45) Date of Patent: Apr. 20, 2021

(54) ENDOTHERMIC SYRINGE SLEEVE

(71) Applicant: Richard Kieffer, Lodi, CA (US)

(72) Inventor: Richard Kieffer, Lodi, CA (US)

( * ) Notice: Subject to any disclaimer, the term of this patent is extended or adjusted under 35 U.S.C. 154(b) by 389 days.

(21) Appl. No.: 16/140,607

(22) Filed: Sep. 25, 2018

(51) Int. Cl.
*B01L 7/04* (2010.01)
*B01L 3/00* (2006.01)
*F25D 11/00* (2006.01)

(52) U.S. Cl.
CPC *B01L 7/04* (2013.01); *B01L 3/50* (2013.01); *F25D 11/003* (2013.01); *F25D 2201/12* (2013.01)

(58) Field of Classification Search
CPC ..... A61F 7/02; A61F 7/03; A61F 7/106
USPC ..... 206/365, 212, 219; 126/205, 208
See application file for complete search history.

(56) References Cited

U.S. PATENT DOCUMENTS 3,643,665 A * 2/1972 Caillouette ..... F24V 30/00 607/114
4,316,473 A 2/1982 Beskin
5,307,933 A * 5/1994 Guignet ..... A61M 5/002 206/443
5,390,791 A 2/1995 Yeager
5,624,638 A * 4/1997 Negrotti ..... B01L 3/502 422/430
5,850,917 A 12/1998 Denton
5,984,087 A * 11/1999 Hacikyan ..... B65D 65/46 206/204
6,161,687 A * 12/2000 Hacikyan ..... B65D 65/46 206/204
6,308,827 B1 * 10/2001 Hacikyan ..... B65D 65/46 206/204
6,968,711 B2 11/2005 Smith
D773,660 S 12/2016 Shiozaki
2001/0050237 A1 * 12/2001 Hacikyan ..... B65D 81/264 206/204
2003/0083722 A1 * 5/2003 Cordani ..... A61F 7/03 607/114
2005/0000508 A1 * 1/2005 Schreft ..... A47J 27/002 126/263.09
2006/0271014 A1 11/2006 Hynes
2007/0125677 A1 * 6/2007 Oronsky ..... B01L 9/06 206/446
2009/0280043 A1 * 11/2009 Ferguson ..... C09K 5/18 422/236
2011/0029051 A1 * 2/2011 Ross ..... A61F 7/02 607/108
2014/0343493 A1 11/2014 Wengreen

FOREIGN PATENT DOCUMENTS

WO 2008153789 12/2008

* cited by examiner

*Primary Examiner* — J. Gregory Pickett
*Assistant Examiner* — Tia Cox
(74) *Attorney, Agent, or Firm* — Kyle A. Fletcher, Esq.

(57) ABSTRACT

The endothermic syringe sleeve is an insulating storage structure. The endothermic syringe sleeve is configured to store a burette that contains an arterial blood samples. The endothermic syringe sleeve is configured to cool the arterial blood sample. The endothermic syringe sleeve is configured to store the arterial blood sample in the cooled state. The endothermic syringe sleeve comprises an endothermic sleeve and the burette. The endothermic sleeve forms a cooled environment within which the burette is stored.

19 Claims, 2 Drawing Sheets

ENDOTHERMIC SYRINGE SLEEVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of instruments and measurements including analyzing the chemical and physical properties of materials, more specifically, a package for storing and transporting a chemical or biological sample stored in a burette. (G01N2001/07)

An arterial blood gas test is a medical procedure that tests blood drawn from an artery. The arterial blood gas test tests: a) the pH of the arterial blood sample; b) the level of dissolved oxygen in the arterial blood sample; and c) the level of dissolved carbon dioxide in the arterial blood sample. It is best to maintain an arterial blood sample in cool to cold conditions for the following reasons: a) the concentration of the dissolved oxygen contained in the arterial blood sample decreases with increases in storage temperature; b) the concentration of the dissolved carbon dioxide contained in the arterial blood sample decreases with increases in storage temperature; and c) undesirable chemical reactions within the arterial blood sample that affect pH are more likely to occur with increases in the storage temperature. Clearly, a method to maintain an arterial blood sample in a cooled state after the draw but before testing would result in more reliable test results.

SUMMARY OF INVENTION

The endothermic syringe sleeve is an insulating storage structure. The endothermic syringe sleeve is configured to store a burette that contains an arterial blood sample. The endothermic syringe sleeve is configured to cool the arterial blood sample. The endothermic syringe sleeve is configured to store the arterial blood sample in the cooled state. The endothermic syringe sleeve comprises an endothermic sleeve and the burette. The endothermic sleeve forms a cooled environment within which the burette is stored.

These together with additional objects, features and advantages of the endothermic syringe sleeve will be readily apparent to those of ordinary skill in the art upon reading the following detailed description of the presently preferred, but nonetheless illustrative, embodiments when taken in conjunction with the accompanying drawings.

In this respect, before explaining the current embodiments of the endothermic syringe sleeve in detail, it is to be understood that the endothermic syringe sleeve is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the endothermic syringe sleeve.

It is therefore important that the claims be regarded as including such equivalent construction insofar as they do not depart from the spirit and scope of the endothermic syringe sleeve. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
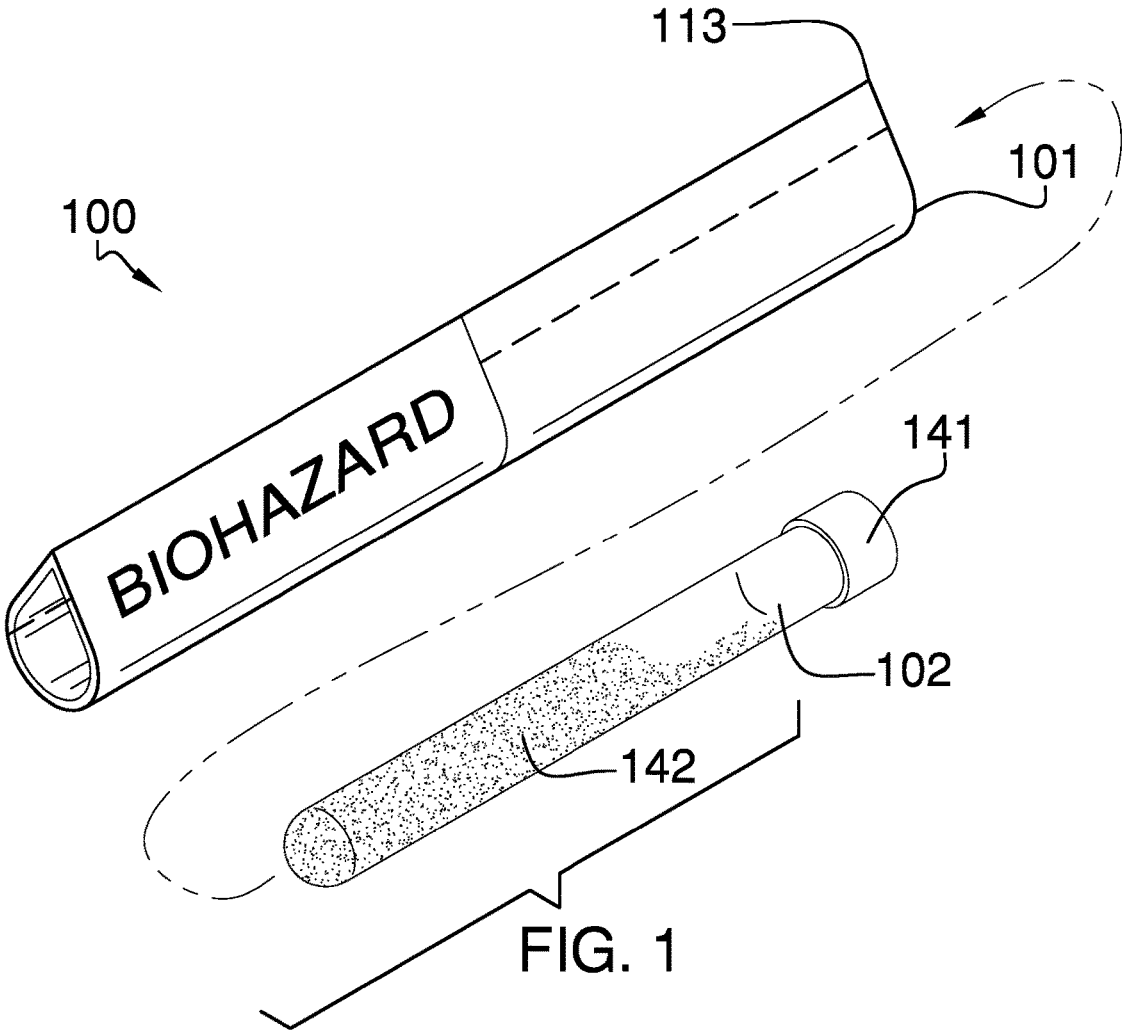
FIG. 1 is a perspective view of an embodiment of the disclosure.
Figure 2:
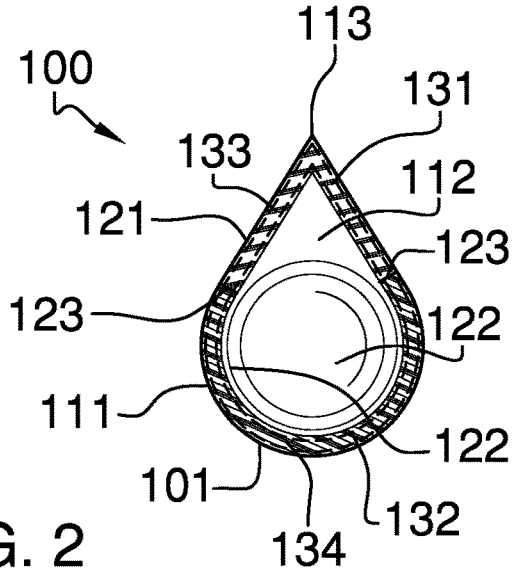
FIG. 2 is a side view of an embodiment of the disclosure.
Figure 3:
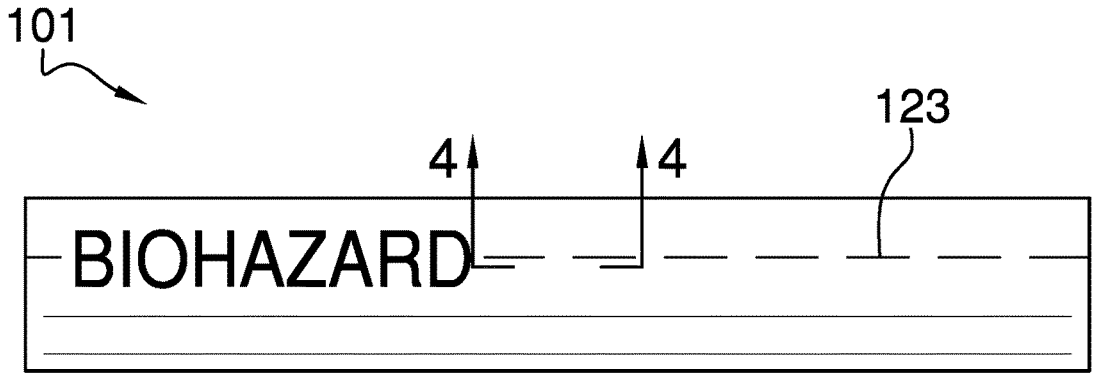
FIG. 3 is a front view of an embodiment of the disclosure.
Figure 4:
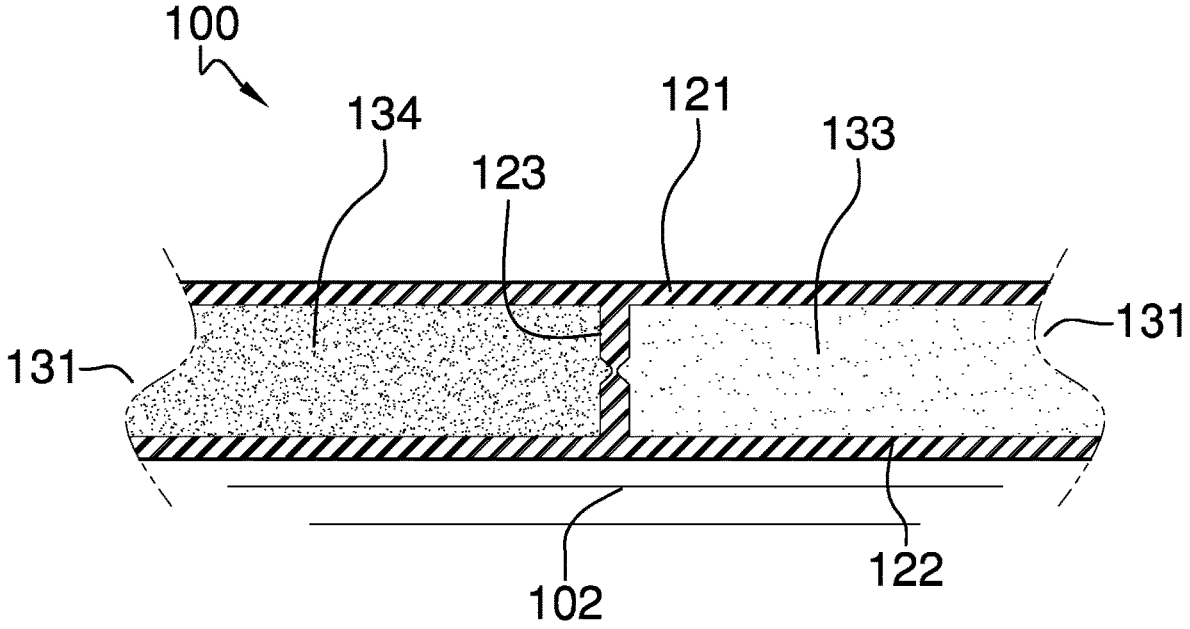
FIG. 4 is a cross-sectional view of an embodiment of the disclosure across 4-4 as shown in FIG. 3.

Detailed reference will now be made to one or more potential embodiments of the disclosure, which are illustrated in FIGS. 1 through 4.

The endothermic syringe sleeve 100 (hereinafter invention) is an insulating storage structure. The invention 100 is configured to store a burette 102 that contains an arterial blood sample 142. The invention 100 is configured to cool the arterial blood sample 142. The invention 100 is configured to store the arterial blood sample 142 in the cooled state. The invention 100 comprises an endothermic sleeve 101 and the burette 102. The endothermic sleeve 101 forms a cooled environment within which the burette 102 is stored.

The burette 102 is a hollow containment structure. The burette 102 has the shape of a composite prism. The burette 102 is configured for use in storing a sample selected from the group consisting of a biological sample and a chemical sample. The burette 102 inserts into the endothermic sleeve 101 such that the selected sample contained within the burette 102 is cooled by the endothermic sleeve 101. The burette 102 further comprises a lid 141 and an arterial blood sample 142. The lid 141 is a mechanical device that encloses the arterial blood sample 142 within the endothermic sleeve 101. The first potential embodiment of the disclosure assumes that the burette 102 contains an arterial blood sample 142. Those skilled in the biological and chemical arts will recognize that the arterial blood sample 142 can be substituted with other biological and chemical materials without undue experimentation.

The burette 102 is defined in greater detail elsewhere in this disclosure.

The endothermic sleeve 101 is a shell. The endothermic sleeve 101 contains the burette 102. The endothermic sleeve 101 is a chemical device that cools the arterial blood sample 142 in the burette 102. The endothermic sleeve 101 is a semi-rigid structure. The chemical reaction contained in the endothermic sleeve 101 is activated by deforming the semi-rigid structure of the endothermic sleeve 101. The endothermic sleeve 101 is deformed by squeezing. The endothermic sleeve 101 comprises a thermal shell 111, a storage chamber 112, and a brink 113.

The thermal shell 111 forms the exterior structure of the endothermic sleeve 101. The thermal shell 111 forms the exterior structure of the invention 100 when the burette 102 inserts into the thermal shell 111. The thermal shell 111 forms a hollow prism structure. The prism structure forms the thermal shell 111 as a teardrop curve prism. The thermal shell 111 is a multi-chamber structure. The thermal shell 111 contains the reactants for an endothermic chemical reaction. The endothermic chemical reaction generates the cooled environment within which the burette 102 is stored. The thermal shell 111 forms an insulating structure that maintains the cooled environment within the hollow interior of the thermal shell 111.

The storage chamber 112 is a storage space contained within the thermal shell 111. The storage chamber 112 is geometrically similar to the thermal shell 111. The inner diameter of the storage chamber 112 is greater than the outer diameter of the burette 102 such that the burette 102 fits within the storage chamber 112. The span of the length of the center axis of the teardrop curve prism structure of the storage chamber 112 is greater than the span of the length of the center axis of the composite prism structure of the burette 102 such that the burette 102 fits within the storage chamber 112.

The brink 113 is an edge that is formed by the teardrop curve prism structure of the endothermic sleeve 101. The edge formed by the brink 113 is characteristic of the teardrop curve shape. The brink 113 is a marker that is positioned at the superior edge of the endothermic sleeve 101 when the endothermic sleeve 101 is deformed to activate the endothermic chemical reaction.

The thermal shell 111 comprises an exterior shell 121, an interior shell 122, and a breakable membrane structure 123.

The exterior shell 121 is a semi-rigid structure. The exterior shell 121 is formed from an insulating material. The exterior shell 121 is a prism structure. The prism structure forms the exterior shell 121 as a teardrop curve prism. The exterior shell 121 forms the exterior surface of the thermal shell 111. The exterior shell 121 is the element of the thermal shell 111 that is deformed to initiate the endothermic chemical reaction.

The interior shell 122 is a rigid structure. The interior shell 122 is geometrically similar to the exterior shell 121. The interior shell 122 inserts into the exterior shell 121 such that the interior shell 122 forms the inner perimeter of the thermal shell 111 and the exterior shell 121 forms the outer perimeter of the thermal shell 111. The interior shell 122 inserts into the exterior shell 121 such that a space is formed between the interior shell 122 and the exterior shell 121.

The breakable membrane structure 123 is a rigid structure. The breakable membrane structure 123 is a barrier structure. The breakable membrane structure 123 is a fluid impermeable structure. The breakable membrane structure 123 forms a bracing structure that attaches the interior surface of the exterior shell 121 to the exterior surface of the interior shell 122. The breakable membrane structure 123 forms a spacing structure that separates the exterior shell 121 from the interior shell 122. The breakable membrane structure 123 segregates the space between the exterior shell 121 and the interior shell 122 into the first reactant chamber 131 and the second reactant chamber 132.

The breakable membrane structure 123 physically separates the contents of the first reactant chamber 131 from the contents of the second reactant chamber 132. The rigid structure of the breakable membrane structure 123 is designed to break when the exterior shell 121 is deformed. The breaking of the breakable membrane structure 123 allows the contents of the first reactant chamber 131 and the second reactant chamber 132 to mix thereby creating the endothermic chemical reaction.

The breakable membrane structure 123 organizes the space between the exterior shell 121 and the interior shell 122 into a first reactant chamber 131 and a second reactant chamber 132.

The first reactant chamber 131 is sealed space within which water 133 is contained. The first reactant chamber 131 is the section of the thermal shell 111 that contains the brink 113. The first reactant chamber 131 contains water 133.

The second reactant chamber 132 is sealed space within which ammonium nitrate (CAS 6484-52-2) 134 is contained. The second reactant chamber 132 is the section of the thermal shell 111 that is distal from the first reactant chamber 131. The second reactant chamber 132 contains ammonium nitrate (CAS 6484-52-2) 134.

The breakable membrane structure 123 is broken while the brink 113 is positioned as the superior edge of the thermal shell 111. The deformation of the exterior shell 121 breaks the breakable membrane structure 123 such that the water 133 in the first reactant chamber 131 flows into the second reactant chamber 132 to mix with the ammonium nitrate (CAS 6484-52-2) 134. The mixture of the water 133 and the ammonium nitrate (CAS 6484-52-2) 134 creates an endothermic chemical reaction that cools the contents of the storage chamber 112 of the endothermic sleeve 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Ammonium Nitrate: As used in this disclosure, ammonium nitrate (CAS 6484-52-2) refers to a chemical compound with the formula NH3HNO3. Ammonium nitrate is a common name for nitric acid ammonium salt. Ammonium nitrate is commonly used for fertilizer and as an oxidizing agent in explosives. Dissolving ammonium nitrate in water results in a rapid endothermic reaction. This reaction is used in the creation of commercially available "instantly" available cold packs. Ammonium nitrate is commonly marketed as a mixture of ammonium nitrate and calcium nitrate (CAS 10124-37-5). The calcium nitrate reduces the oxidizing potential of the ammonium nitrate such that the ammonium nitrate is not considered an oxidizing agent under United States Department of Transportation regulations. The introduction of calcium nitrate into the ammonium nitrate does not reduce the effectiveness of the ammonium nitrate as a fertilizer or the use of ammonium nitrate in an endothermic reaction.

Brink: As used in this disclosure, a brink refers to the discontinuous edge or line formed by the intersection of a first plane or surface and a second plane or surface wherein a cant exists between the first plane or surface and the second plane or surface.

Burette: As used in this disclosure, a burette is a containment structure used to store biological and chemical samples. The burette has a composite prism structure. The burette is formed in the fashion of a capped tube. A test tube is a burette wherein the composite prism is formed from a hollow cylindrical prism structure and a hemispherical structure. A burette is often provisioned with a lid.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable negative space that is dedicated to a purpose.

Composite Prism: As used in this disclosure, a composite prism refers to a structure that is formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. Specifically, the surface area of an end of the prism-shaped object that forms the disk is greater than the lateral face of the prism-shaped object that forms the disk. In this disclosure, the ends of the prism-shaped structure that forms the disk are referred to as the faces of the disk.

Endothermic: As used in this disclosure, the term endothermic refers to a chemical reaction that requires the addition of heat to enable the reaction.

Exothermic: As used in this disclosure, the term exothermic refers to a chemical reaction that releases heat as a result of the reaction.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hemisphere: As used in this disclosure, a hemisphere is a structure formed in the shape of a half a sphere. Such a structure would be described as hemispherical.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Inner Perimeter and Outer Perimeter: As used in this disclosure, the inner perimeter and the outer perimeter refer to two geometrically similar structures of a curved object. The inner perimeter refers to the geometrically similar structure with the shorter span. The outer perimeter refers to the geometrically similar structure with the greater span.

Insulating Material: As used in this disclosure, an insulating material is a structure that inhibits, and ideally prevents, the transfer of heat through the insulating material. Insulating materials may also be used to inhibit or prevent the transfer of sound or the conduction of electricity through the insulating material. Methods to form insulating materials include, but are not limited to: 1) the use of materials with low thermal conductivity; and, 2) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Ion: As used in this disclosure, an ion is an atom or a molecule with a net electric charge.

Ionic Bond: As used within this disclosure, an ionic bond refers to a chemical bond between a first atom and a second atom wherein the first atom takes an electron from the second atom. This is in contrast to a covalent bond.

Lid: As used in this disclosure, a lid is a removable cover that is placed over an opening of a hollow structure to enclose the hollow structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions. In this disclosure, a metallic element is assumed to include the alkali metals and the alkali earth metals. Alternatively, and equivalently, a metallic element may be assumed to be any element on the periodic table that is to the left of the metalloids.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shell: As used in this disclosure, a shell is a structure that forms an outer covering intended to contain an object. Shells are often, but not necessarily, rigid or semi-rigid structures that are intended to protect the object contained within it.

Sleeve: As used in this disclosure, a sleeve is a tube-like covering that is placed over a rod, shaft or other cylindrical object.

Squeeze: As used in this disclosure, to squeeze means to compress an object by hand.

Superior: As used in this disclosure, the term superior refers to a directional reference that is parallel to and in the opposite direction of the force of gravity when an object is positioned or used normally.

Teardrop Curve: As used in this disclosure, a teardrop curve refers to the curvature formed by a falling drop of water along a surface—such as a teardrop. The teardrop curve is well described by the equation: $y\hat{}2=x^{m}*(1-x)$ $(0<x<1)$; or the equivalent parametric equations: $x=\cos(t)$ and $y=\sin(t)*\sin^{m-1}$ $(0.5*t)$. Within this mathematical description, the x axis bifurcates the teardrop along the length of the teardrop. Values of m can vary, but a value between greater than 2 and less than 8 are suitable for most purposes.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A biological sample package comprising:

an endothermic sleeve and the burette;

wherein the endothermic sleeve forms a cooled environment within which the burette is stored;

wherein the biological sample package is an insulating storage structure;

wherein the package biological sample package stores the burette that contains a blood sample;

wherein the burette is configured for use in storing a sample selected from the group consisting of a biological sample and a chemical sample;

wherein the package biological sample package is configured to cool the selected sample;

wherein the package biological sample package is configured to store the selected sample in the cooled state;

wherein the burette is a hollow containment structure;

wherein the burette has the shape of a composite prism;

wherein the burette inserts into the endothermic sleeve such that the selected sample contained within the burette is cooled by the endothermic sleeve.

2. The package biological sample package according to claim 1 wherein the endothermic sleeve is a shell;

wherein the endothermic sleeve is a chemical device that cools the selected sample in the burette;

wherein the endothermic sleeve is a semi-rigid structure.

3. The package biological sample package according to claim 2 wherein the chemical reaction contained in the endothermic sleeve is activated by deforming the semi-rigid structure of the endothermic sleeve;

wherein the endothermic sleeve is deformed by squeezing.

4. The package biological sample package according to claim 3 wherein the burette further comprises a lid and the selected sample;

wherein the lid is a mechanical device;

wherein the lid encloses the selected sample within the endothermic sleeve.

5. The package biological sample package according to claim 4 wherein the endothermic sleeve comprises a thermal shell, a storage chamber, and a brink;

wherein the storage chamber is formed within the thermal shell;

wherein the brink is formed on the exterior of the thermal shell.

6. The package biological sample package according to claim 5 wherein the thermal shell forms the exterior structure of the endothermic sleeve;

wherein the thermal shell forms the exterior structure of the biological sample package when the burette inserts into the thermal shell;

wherein the thermal shell forms a hollow prism structure.

7. The package biological sample package according to claim 6 wherein the hollow prism structure that forms the thermal shell is a teardrop curve prism.

8. The package biological sample package according to claim 7 wherein the thermal shell is a multi-chamber structure.

9. The package biological sample package according to claim 8 wherein the thermal shell contains the reactants for an endothermic chemical reaction;

wherein the endothermic chemical reaction generates the cooled environment within which the burette is stored;

wherein the endothermic chemical reaction is initiated when the thermal shell is deformed.

10. The package biological sample package according to claim 9 wherein the storage chamber is a storage space contained within the thermal shell;

wherein the storage chamber is geometrically similar to the thermal shell;

wherein the inner diameter of the storage chamber is greater than the outer diameter of the burette such that the burette fits within the storage chamber;

wherein the span of the length of the center axis of the teardrop curve prism structure of the storage chamber is greater than the span of the length of the center axis of the composite prism structure of the burette such that the burette fits within the storage chamber.

11. The package biological sample package according to claim 10 wherein the thermal shell forms an insulating structure that maintains the cooled environment within the storage chamber.

12. The package biological sample package according to claim 11 wherein the brink is an edge that is formed by the teardrop curve prism structure of the endothermic sleeve;

wherein the brink is a marker;

wherein the brink is positioned at the superior edge of the endothermic sleeve when the endothermic sleeve is deformed to activate the endothermic chemical reaction.

13. The package biological sample package according to claim 12 wherein the thermal shell comprises an exterior shell, an interior shell, and a breakable membrane structure;

wherein the breakable membrane attaches the exterior shell to the interior shell.

14. The package biological sample package according to claim 13 wherein the exterior shell is a semi-rigid structure;

wherein the exterior shell is formed from an insulating material;

wherein the exterior shell is a prism structure;

wherein the prism structure forms the exterior shell as a teardrop curve prism;

wherein the exterior shell forms the exterior surface of the thermal shell.

15. The package biological sample package according to claim 14 wherein the exterior shell is the element of the thermal shell that is deformed to initiate the endothermic chemical reaction.

16. The package biological sample package according to claim 15 wherein the interior shell is a rigid structure;

wherein the interior shell is geometrically similar to the exterior shell;

wherein the interior shell inserts into the exterior shell such that the interior shell forms the inner perimeter of the thermal shell and the exterior shell forms the outer perimeter of the thermal shell;

wherein the interior shell inserts into the exterior shell such that a space is formed between the interior shell and the exterior shell.

17. The package biological sample package according to claim 16 wherein the breakable membrane structure is a rigid structure;

wherein the breakable membrane structure is a barrier structure;

wherein the breakable membrane structure is a fluid impermeable structure;

wherein the breakable membrane structure forms a bracing structure that attaches the interior surface of the exterior shell to the exterior surface of the interior shell;

wherein the breakable membrane structure forms a spacing structure that separates the exterior shell from the interior shell.

18. The package biological sample package according to claim 17 wherein the breakable membrane structure segregates the space between the exterior shell and the interior shell into the first reactant chamber and the second reactant chamber;

wherein the breakable membrane structure physically separates the contents of the first reactant chamber from the contents of the second reactant chamber;

wherein the rigid structure of the breakable membrane structure breaks when the exterior shell is deformed;

wherein the breaking of the breakable membrane structure allows the contents of the first reactant chamber and the second reactant chamber to mix thereby creating the endothermic chemical reaction.

19. The package biological sample package according to claim 18 wherein the breakable membrane structure organizes the space between the exterior shell and the interior shell into a first reactant chamber and a second reactant chamber;

wherein the first reactant chamber is sealed space;

wherein the second reactant chamber is sealed space;

wherein the first reactant chamber is the section of the thermal shell that contains the brink;

wherein the second reactant chamber is the section of the thermal shell that is distal from the first reactant chamber;

wherein the first reactant chamber contains water;

wherein the second reactant chamber contains ammonium nitrate;

wherein the deformation of the exterior shell breaks the breakable membrane structure such that the water in the first reactant chamber flows into the second reactant chamber to mix with the ammonium nitrate;

wherein the mixture of the water and the ammonium nitrate creates an endothermic chemical reaction that cools the contents of the storage chamber.

* * * * *